US012790797B2

(12) United States Patent
Burke et al.

(10) Patent No.: US 12,790,797 B2
(45) Date of Patent: Nov. 10, 2026

(54) WATER SUPPLY MONITORING SYSTEM

(71) Applicant: Watts Regulator Co., North Andover, MA (US)

(72) Inventors: Joseph Michael Burke, Deerfield, NH (US); Ian David Baynes, Merrimac, MA (US); Matthew Fratantonio, Northborough, MA (US)

(73) Assignee: Watts Regulator Co., North Andover, MA (US)

( * ) Notice: Subject to any disclaimer, the term of this patent is extended or adjusted under 35 U.S.C. 154(b) by 286 days.

(21) Appl. No.: 18/428,070

(22) Filed: Jan. 31, 2024

(65) Prior Publication Data

US 2024/0254738 A1 Aug. 1, 2024

Related U.S. Application Data

(60) Provisional application No. 63/482,420, filed on Jan. 31, 2023.

(51) Int. Cl.
*E02B 7/12* (2006.01)
*E03B 7/07* (2006.01)
*E03B 7/12* (2006.01)

(52) U.S. Cl.
CPC ..... *E03B 7/12* (2013.01); *E03B 7/077* (2013.01)

(58) Field of Classification Search
CPC ..... E03B 7/12; E03B 7/077
See application file for complete search history.

(56) References Cited

U.S. PATENT DOCUMENTS

| | | | | |
|---|---|---|---|---|
| 5,694,963 | A | 12/1997 | Fredell et al. | |
| 6,987,457 | B2 | 1/2006 | Yin et al. | |
| 7,949,433 | B2 | 5/2011 | Hern et al. | |
| 8,744,773 | B2 | 6/2014 | Woytowitz et al. | |
| 10,858,811 | B2 * | 12/2020 | Schloss | E03B 7/04 |
| 2019/0024351 | A1 * | 1/2019 | Schloss | E03B 7/075 |

OTHER PUBLICATIONS

Series 765 Pressure Vacuum Breakers, FEBCO product specifications, a WATTS Brand, USA, Canada, Latin America, 2008, 3 pages.

(Continued)

*Primary Examiner* — Randy W Gibson
(74) *Attorney, Agent, or Firm* — Secant IP, PLLC

(57) ABSTRACT

A system to monitor and control a water supply includes a plumbing fixture coupled to a water supply; a temperature sensor to generate temperature sensor data indicative of an ambient temperature around the plumbing fixture; and a controller including a battery power supply. The controller is configured to determine a first battery level of the battery power supply, responsive to determining that the first battery level exceeds a first battery level threshold, the controller is also configured to set a timer to a first time duration; the controller is further configured to determine a first temperature for the one or more temperature sensors based on the temperature sensor data and responsive to determining that the first temperature satisfies a first condition, the controller is also configured to cause a transmission of a first notification corresponding to the first condition to a remote computing device.

18 Claims, 7 Drawing Sheets

(56) References Cited

OTHER PUBLICATIONS

Wireless Rain-Clik Owner's Manual, Hunter Industries Incorporated, San Marcos, CA, Oct. 25, 2017, pp. 1-20.
BMS Flood Sensor Retrofit Connection Kit for Relief Valve Discharge Line Installation Instructions, WATTS, USA, Canada, Latin America, 2023, pp. 1-12.
RTP 199 X 106847 A Polypropylene Electrically Conductive High Melt Flow Rate Product Data Sheet & General Processing Conditions, RTP Company, Winona, MN, Dec. 14, 2010, 2 pages.
Part No. SA-CFSRVBC28, WATTS Data Sheet, North Andover, MA, Nov. 8, 2023, 1 page.
Part No. SA-CFSRVCA19, WATTS Data Sheet, North Andover, MA, Jul. 29, 2022, 2 pages.

* cited by examiner

WATER SUPPLY MONITORING SYSTEM

CROSS REFERENCE TO RELATED APPLICATIONS

This application claims the benefit of U.S. Provisional Application Ser. No. 63/482,420, filed 31 Jan. 2023, which is hereby incorporated by reference in its entirety.

TECHNICAL FIELD

The present disclosure relates to systems and methods for monitoring a water supply, and, in particular, to systems and methods to monitor and control a water supply system to prevent freezing events.

BACKGROUND

Backflow preventers are used throughout the world, for example, as part of residential or commercial irrigation systems and/or residential or commercial water systems in buildings. Typically, backflow preventors are installed outside and are thus subject to environmental temperatures. In the case of an unexpected freeze event, backflow preventors can freeze and cause damage to the water supply and/or structures near the water supply product damage.

BRIEF DESCRIPTION OF THE DRAWINGS

Features and advantages of various embodiments of the claimed subject matter will become apparent as the following Detailed Description proceeds, and upon reference to the Drawings, wherein like numerals designate like parts, and in which:

Although the following Detailed Description will proceed with reference being made to illustrative embodiments, many alternatives, modifications and variations thereof will be apparent to those skilled in the art.

DETAILED DESCRIPTION

The present disclosure provides systems and methods to efficiently prevent malfunctioning plumbing fixtures in water supply systems. In embodiments, the system includes a plumbing fixture (e.g., backflow preventer) and a controller for monitoring and preventing backflow freeze. The controller is configured for measuring ambient air temperature around the plumbing fixture, generating notifications to alert a user of conditions that may prevent proper functioning of the plumbing fixture, and in some embodiments, executing actions to prevent water flowing through the backflow preventer from freezing. Further, the controller is configured for increasing or preserving the state of the one or more batteries (e.g., battery power level) used to power a temperature sensor affixed to the plumbing fixture to avoid power failure in the protective temperature sensor devices. Embodiments of the present disclosure may also include an activated switch to preserve battery power when temperatures are not close to or at freezing temperatures. Additionally, to further enhance battery power management, the controller may be configured for sampling temperature data from the temperature sensors at different rates based on the temperature detected within the environment in which the water supply system is located.

Figure 1:
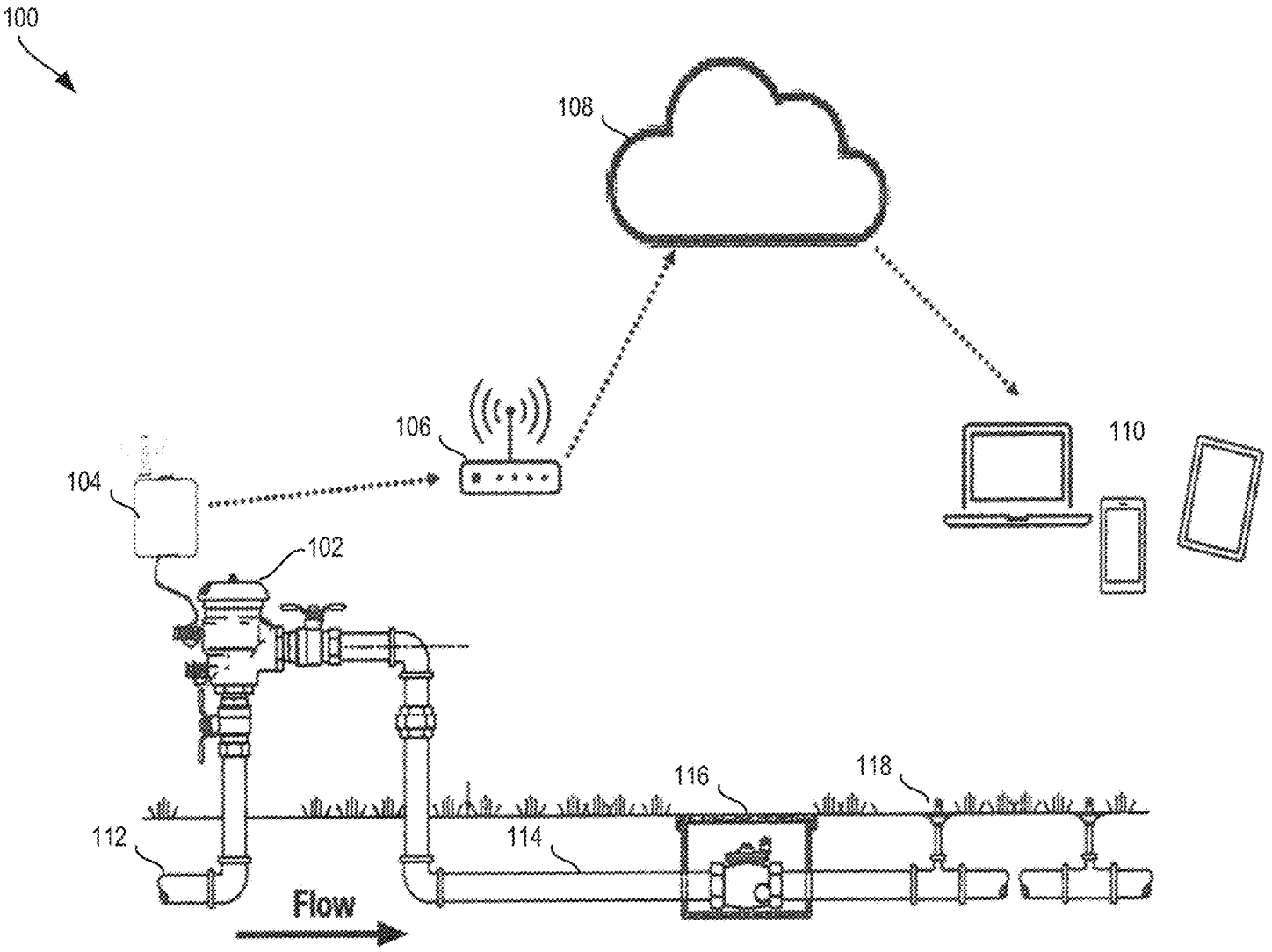
FIG. 1 illustrates a water supply system 100 consistent with several embodiments of the present disclosure.

FIG. 1 illustrates a water supply system 100 consistent with several embodiments of the present disclosure. The system 100 includes a plumbing fixture 102 and temperature monitoring and control circuitry 104 ("controller 104"). The controller 104 is configured to exchange commands and data with communication devices that may include, for example, WiFi router circuitry 106 coupled to one or more remote personal electronic devices 110, via network 108. As a general overview, and as will be described in greater detail herein, the controller 104 is configured to monitor an ambient temperature around the plumbing fixture 102 and to communicate temperature conditions and/or events to the one or more remote devices 110 so that a user is updated with information regarding the state (or potential condition) of the plumbing fixture 102 and/or the water supply system coupled to the plumbing fixture 102. In some embodiments, the controller 104 is a battery powered and field deployable unit, and the controller 104 is configured to provide power saving modes to extend battery life. In some embodiments, the plumbing fixture 102 may be an electronically controllable plumbing fixture 102 and the controller 106 may be further configured to control the electronically controllable plumbing fixture 102 to cause a desired action, for example, opening a controllable valve to prevent freezing damage based on temperature information gathered by the controller 104. These embodiments are described in greater detail below.

In the example of FIG. 1, the plumbing fixture 102 is a backflow preventer coupled to other plumbing components of an irrigation system, for example, a water supply source 112, one or more controlled water supplies 114 via the backflow preventer 102, one or more manifolds 116 and one or more feed irrigation lines 118. Of course, the irrigation system illustrated in FIG. 1 is provided only as a non-limiting example of the types of water supply systems that may utilize the teachings of the present disclosure, and indeed the teachings provided herein may be used with a variety of water supply systems (e.g., other irrigation systems, main water supply systems, etc.). In addition, while the following examples describe monitoring and/or control of a backflow preventor (102), in other embodiments, the controller 104 may be configured to monitor and/or control other plumbing fixtures 102 in a water supply system.

The communications devices 106, 108, 110 are illustrated as an example of a communication system that may be present at a particular residential and/or commercial location. Network 108 operates as a computing network that can be, for example, a local area network (LAN), a wide area network (WAN), or a combination of the two, and can include wired, wireless, or fiber optic connections. In general, network 108 can be any combination of connections and protocols that will support communications between the controller 104 and the one or more computing devices 110. The one or more computing devices may collectively or individually include any electronic device or computing system capable of receiving and sending data, for example, a laptop computer, tablet computer, netbook computer, personal computer (PC), a desktop computer, a smart phone, or any programmable electronic device capable of exchanging commands and data with controller 104.

Figure 2:
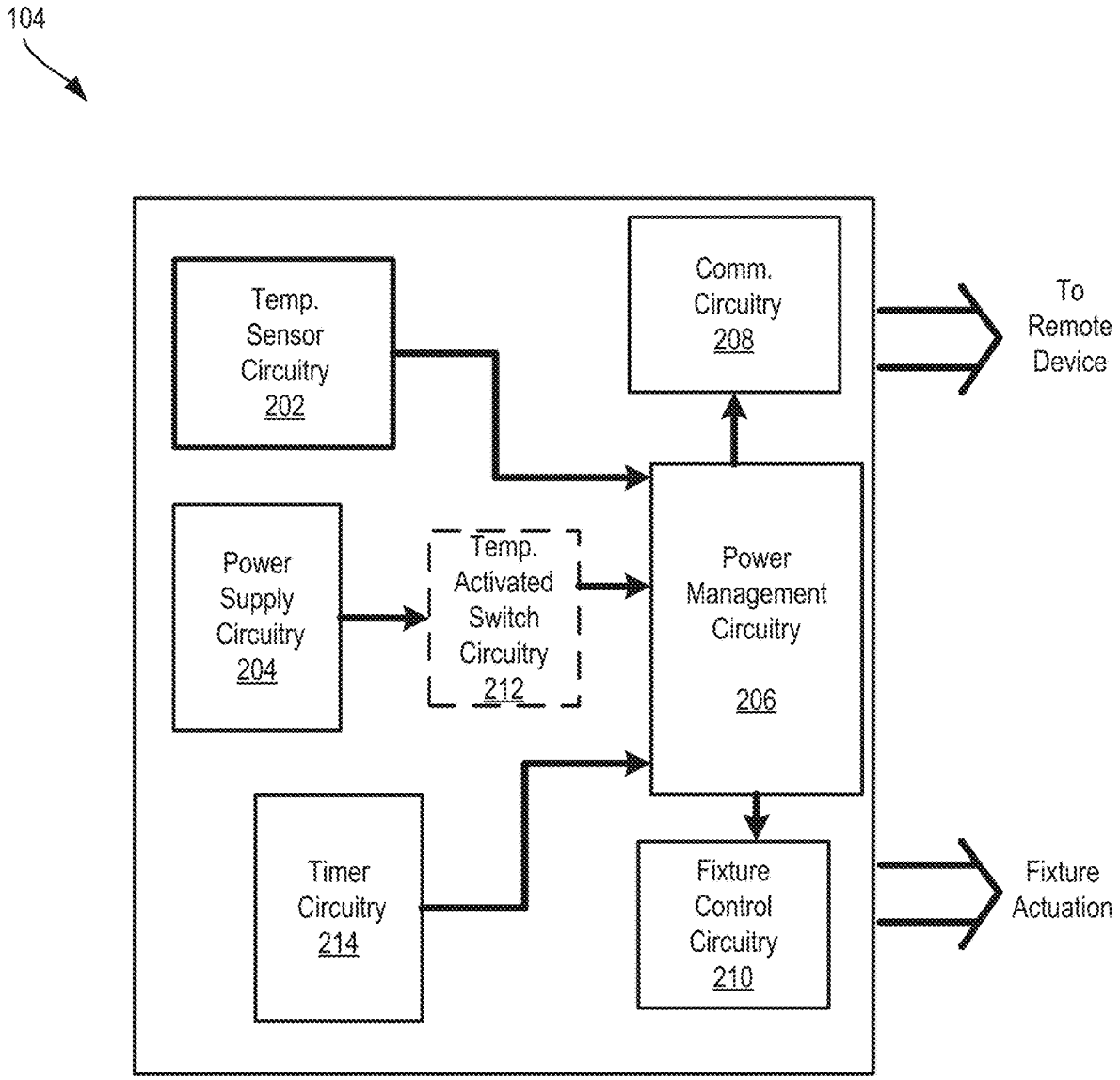
FIG. 2 illustrates a controller 104 consistent with embodiments of the present disclosure.

FIG. 2 illustrates one example of a controller 104 consistent with embodiments of the present disclosure. The controller 104 generally includes temperature sensor circuitry 202 generally configured to generate a temperature signal indicative of an ambient (environmental) temperature. The controller 104 also includes power supply circuitry 204 generally configured to supply power to components of the controller 104 described herein. The power supply circuitry 204 may include one or more batteries (e.g., replaceable batteries), thus eliminating the need for a dedicated AC power supply for the controller 104. The controller 104 also includes power management circuitry 206 generally configured to control power among the components of the controller 104 and to provide battery power management, as will be described in detail below. The controller 104 also includes communications circuitry 208 generally configured to exchange commands and data with one or more remote devices 110 (FIG. 1), via a network or the like. The communications circuitry 208 may communicate using known and/or proprietary and/or after-developed communications protocols, for example, WiFi communications, cellular communications, near-field communications (e.g., Bluetooth, etc.), etc.

The controller 104 also includes fixture control circuitry 210 generally configured to generate one or more command signals to control an operation of a plumbing fixture. Using a backflow preventor as a fixture example, the backflow preventor may include an electronically controlled valve which may be opened (i.e., permitting water flow) when activated by the fixture control circuitry 210, as will be described below. In some embodiments, the controller 104 may also include a temperature activated switch 212 coupled between the power supply circuitry 204 and the power management circuitry 206, and generally configured to decouple the power supply circuitry 204 from other components of the controller 104 until a selected ambient temperature causes the switch circuitry 212 to close and complete a circuit. In one example, the temperature activated switch circuitry 212 may include a normally closed thermostatic switch selected to close at a temperature that is near freezing (e.g., switch closes when the ambient temperature drops below a threshold (e.g., 40 degrees)).

Figure 6B:
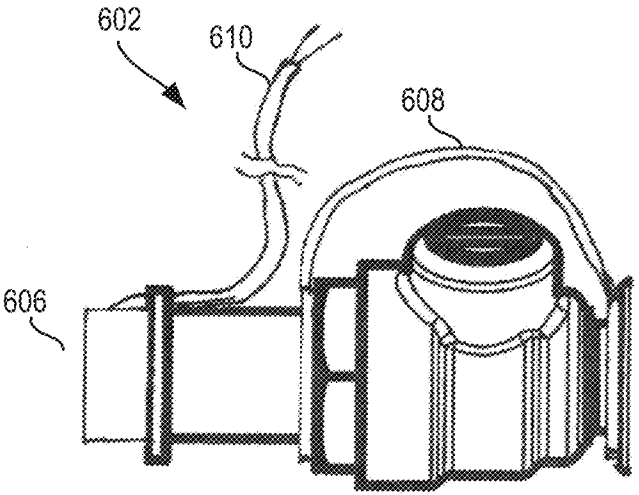
FIGS. 6A, 6B and 6C illustrate various views of an example backflow preventer with a temperature sensor attached thereto.
Figure 6C:
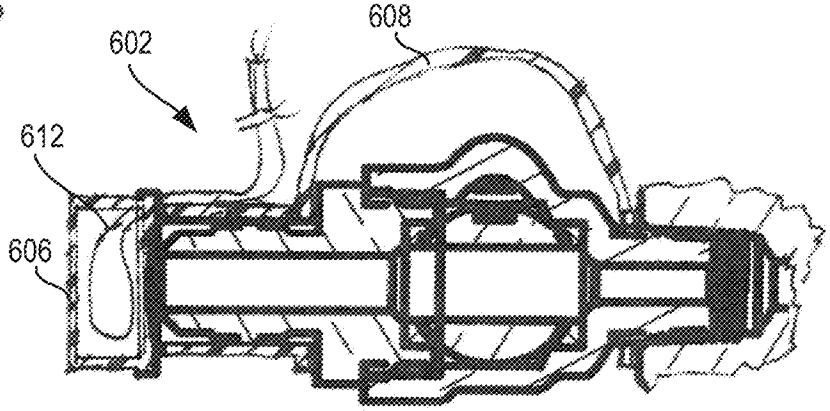
Figure 6A:
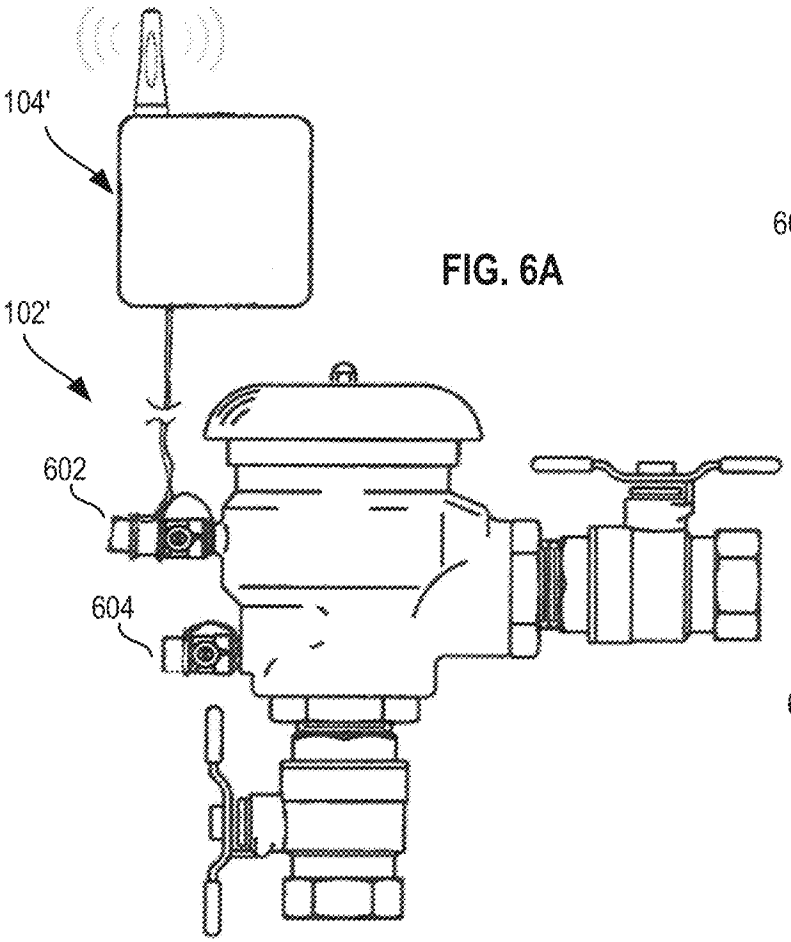
Figure 7:
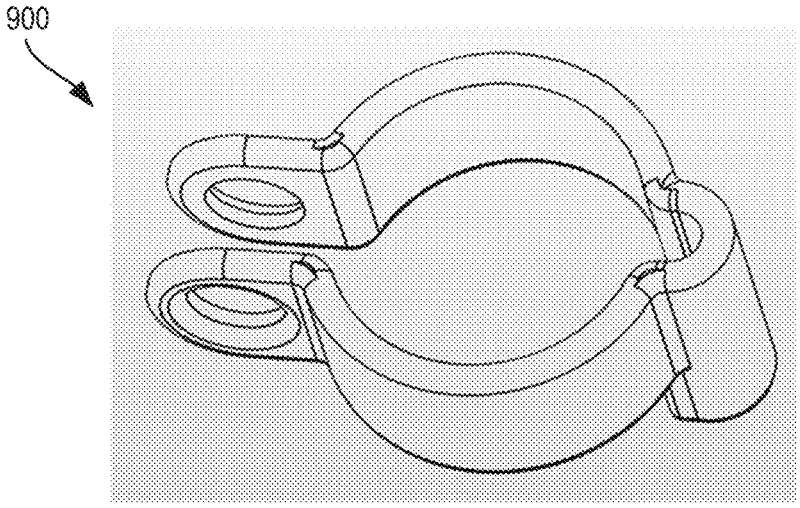
FIGS. 7, 8 and 9 illustrate example temperature sensor clamps according to various embodiments of the present disclosure.
Figure 8:
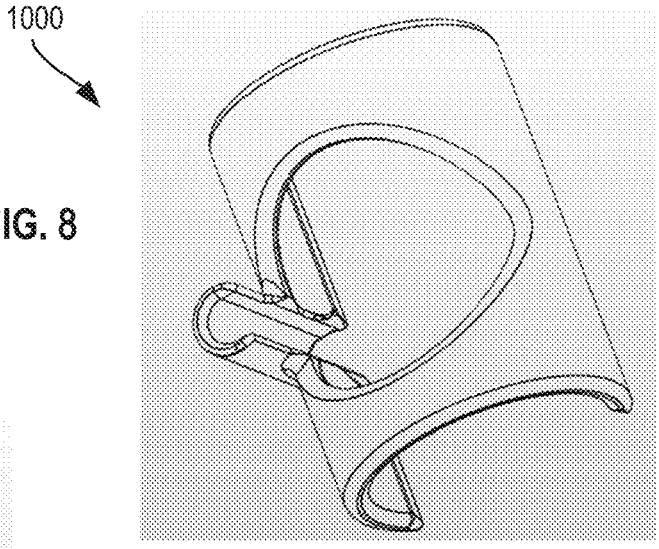
Figure 9:
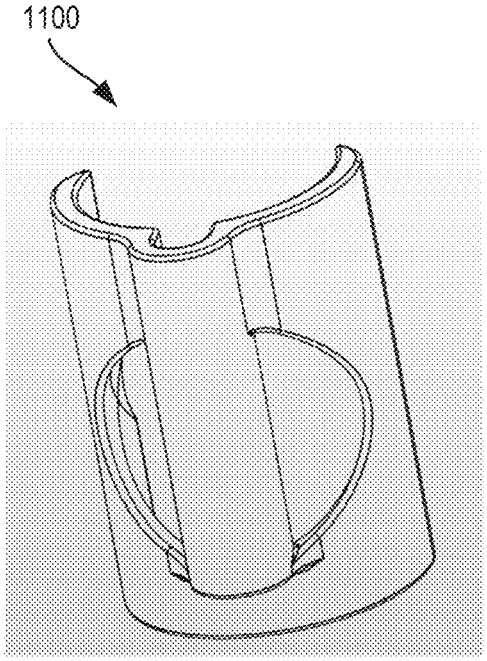

In some embodiments, the temperature sensor circuitry 204 may be removably affixed to a fixture installed within the water supply system. For example, FIG. 6A illustrates an example embodiment of a backflow preventor 102' having a temperature sensor attached thereto in communication with the controller 104'. The backflow preventer 102' of this example embodiment is the Watts® 765 Backflow Preventer Valve that includes test cocks 602/604 that allow the valve to be pressure tested to check for leaking. Typically, a test cock, for example, test cock 602 illustrated in close up in FIG. 6B, includes a cover 606. In this embodiment, a temperature sensor is attached to the test cock 602 under the cover 606. The cover may include a lanyard 608 to prevent loss of the cover 606. FIG. 6C illustrates the test cock 602 in a cutaway view, and illustrates a temperature sensor 612 installed under the cover 606. Of course, FIGS. 6A, 6B and 6C are provided only as a non-limiting example of a temperature sensor attached to a plumbing fixture, and as noted above, the temperature sensor may be attached to any of the plumbing fixture of a water system. In other embodiments, the temperature sensor circuitry 204 may be secured to backflow preventer valve (or other plumbing fixture) via a clamp. Examples of such clamps are depicted in FIGS. 7, 8 and 9, and generally illustrate clamp devices 900, 1000, and 1100, respectively, to secure a temperature sensor to the housing of a backflow preventor, such as illustrated in FIG. 1.

The power management circuitry 206 is generally configured to manage power levels in the one or more batteries of the power supply circuitry 204, and generate one or more reporting alerts regarding power levels and ambient temperature to a remote device 110. To that end, the controller 104 may also include timer circuitry 214 generally configured to be controlled by the power management circuitry to set timers for various operations, based on power levels in the batteries. The timers are utilized to provide control over power drain from the batteries. In addition, the power management circuitry 206 may control the fixture control circuitry 210 to trigger an action in one or more fixtures in communication with the controller 104. Power management and component control operations are described below with reference to FIGS. 3, 4 and 5.

Figure 3:
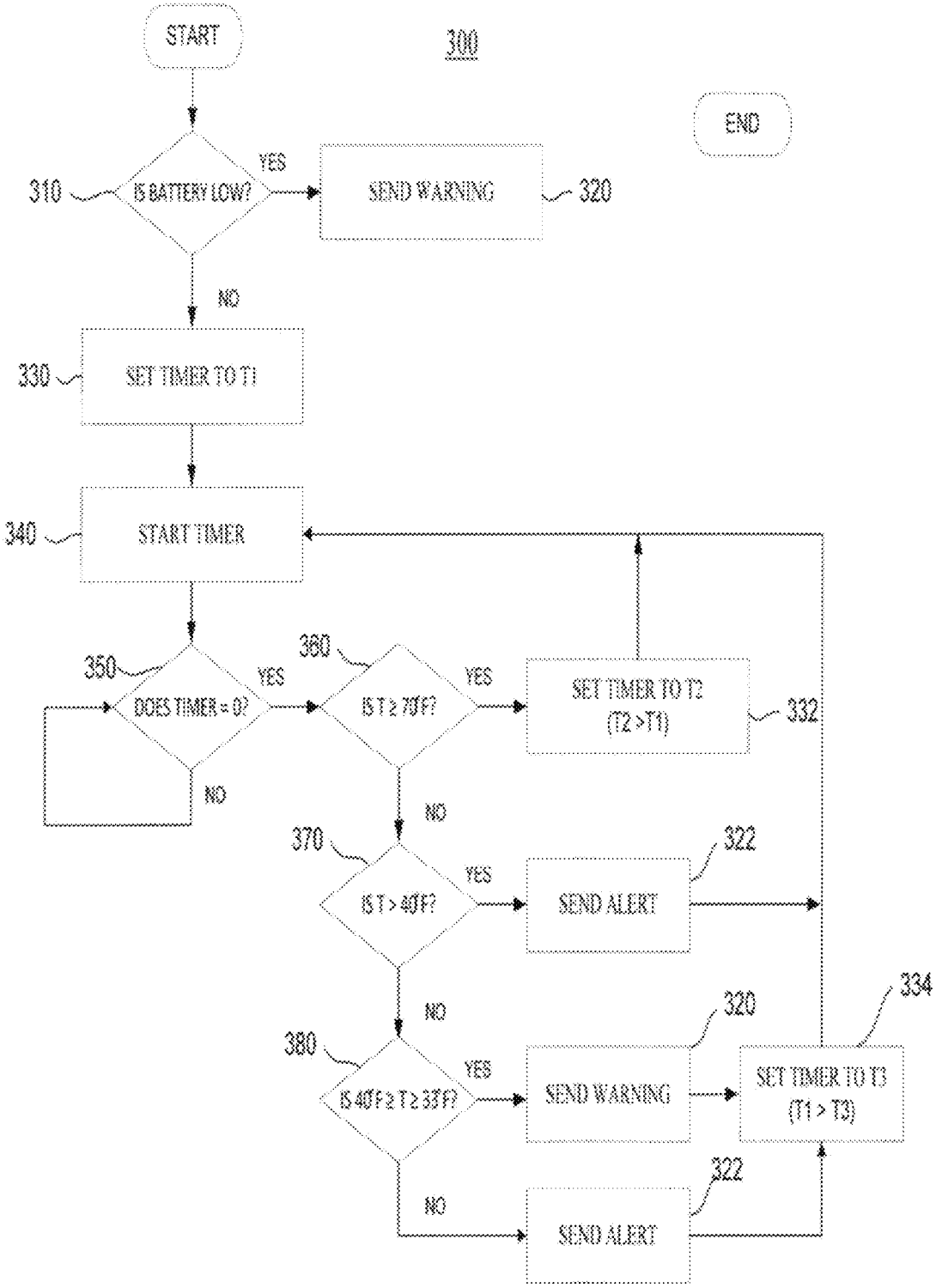
FIG. 3 illustrates a flowchart 300 of operations of the power management circuitry, in accordance with an embodiment of the present disclosure.

FIG. 3 illustrates a flowchart 300 of operations of the power management circuitry, in accordance with an embodiment of the present disclosure. Operations of this embodiment include determining if the battery is below a selected threshold (e.g., is battery low? 310). Responsive to determining that the battery is low, operations include generating and transmitting a warning (e.g., send warning 320) to a computing device alerting an associated user of the low battery. Operations also include, responsive to determining that the battery is not low, setting a timer to T1 (e.g., set timer to T1 330), wherein T1 corresponds to a first time duration. Responsive to setting the timer to T1, operations also include starting a timer (e.g., start timer 340).

Operations also include, responsive to starting the timer, determining if the timer=0 or if the timer has expired (e.g., does timer=0? 350). Operation 350 may be repeated continually or periodically to determine if the timer=0. If timer=0, operations also include determining if the temperature detected at the temperature sensor is greater than or equal to 70° F. (e.g., is T≥70° F. 360). Responsive to determining that the temperature is greater than or equal to 70° F., operations also include setting the timer to T2 (e.g., set timer to T2 332), wherein T2 is a second time duration that may be greater than T1.

Operations also include, responsive to determining that the temperature is greater than 40° F. (e.g., is T>40° F. 370), generating an alert (e.g., send alert 322) to the computing device indicating the temperature is greater than 40° F. In an embodiment, responsive to determining that the temperature is not greater than 40° F., operations include determining if the temperature is less than or equal to 40° F. and greater than or equal to 33° F. (e.g., 40° F.≥T≥33° F. 380). Responsive to determining that the temperature is not less than or equal to 40° F. and greater than or equal to 33° F., operations include generating an alert (e.g., send alert 322) to the computing device indicating the temperature is not less than or equal to 40° F. and greater than or equal to 33° F. In addition to sending the alert, operations may also include setting the timer to T3 (e.g., set timer to T3 334) corresponding to a third time duration that is less than T1 or wherein T1 is greater than T3. For example, setting the timer to a shorter duration after detecting the temperature is at the lowest threshold before freezing increases the frequency in which temperature samples are retrieved from the temperature sensors, allowing increased data access to notify the user of potentially freezing conditions that may disable the backflow preventer.

As temperatures approach 32 degrees, operations of this embodiments may also include controlling fixture control circuitry to cause a fixture to begin to reduce pressure in a water supply system. For example, the fixture control circuitry may actuate a valve to open or partially open so that pressure is reduced in a water supply system as temperatures near freezing.

Figure 4:
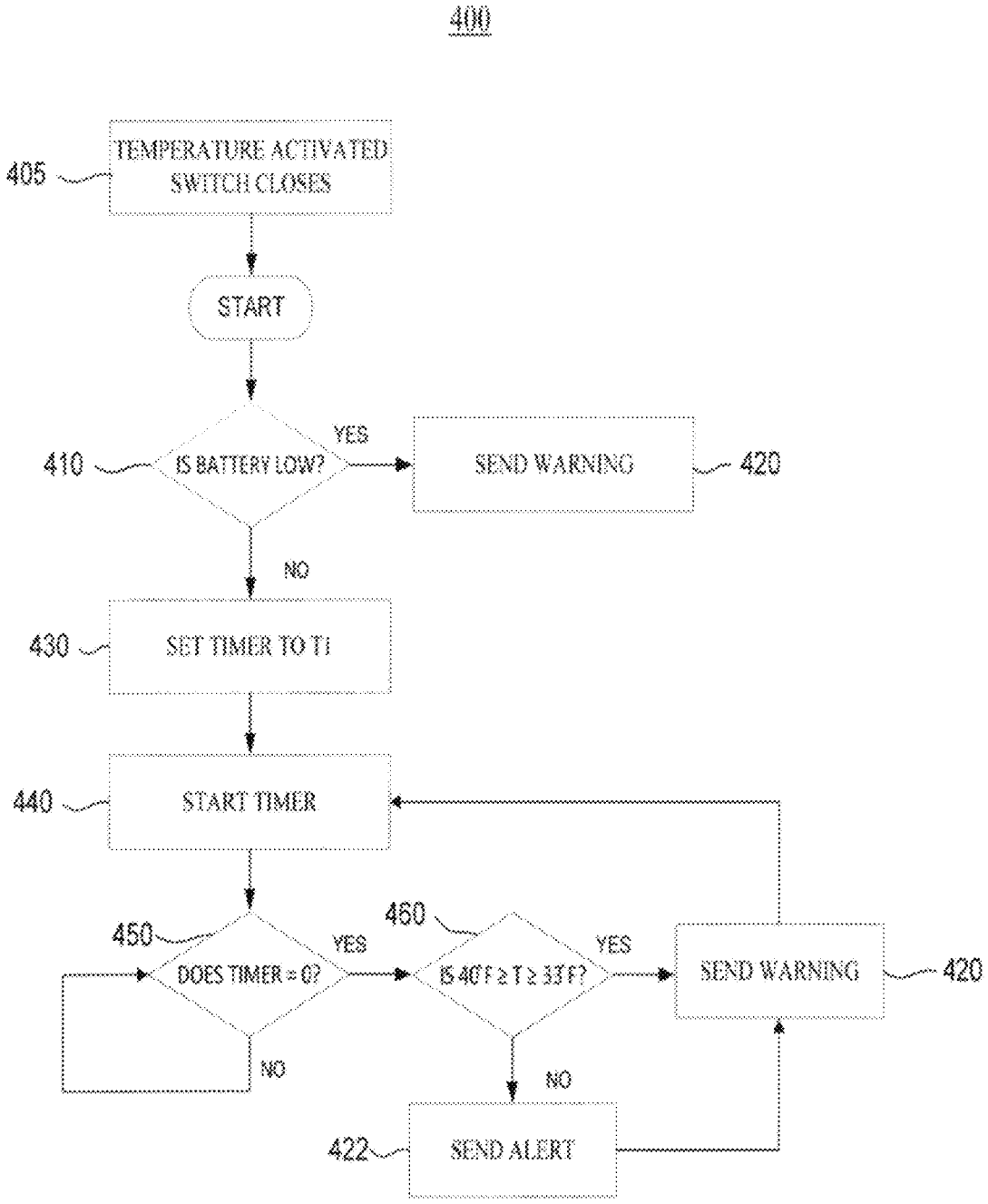
FIG. 4 illustrates a flowchart 400 of power management using a temperature switch, in accordance with an embodiment of the present disclosure.

FIG. 4 illustrates a flowchart 400 of power management using a temperature switch, in accordance with an embodiment of the present disclosure. In this embodiment, responsive to determining that a temperature at a location of a water supply system is less than 33 degrees Fahrenheit, a temperature activated switch is closed (e.g., temperature activated switch closes 405) to energize power management circuitry. For example, the temperature activated switch may be configured to close upon detecting an ambient temperature that is less than or equal to 33 degrees Fahrenheit. Non-limiting examples of temperature activated switches include KSD301 model disc bimetal thermostat as well as KSD9700 bimetal temperature control switch, both of which are available from a wide variety of manufacturers.

Responsive to closing the temperature activated switch, operations include determining if the battery for the temperature sensor is low (e.g., is battery low? 410). Responsive to determining that the battery for the temperature sensor is low, operations include generating a warning (e.g., send warning 420) to a computing device alerting an associated user of the low battery.

If the battery is not low, operations include setting a timer to T1 (e.g., set timer to T1 430), wherein T1 corresponds to a first time duration. Responsive to setting the timer to T1, operations include starting the timer (e.g., start timer 440). Responsive to starting the timer, operations include determining if the timer=0 or if the timer has expired (e.g., does timer=0? 450). For example, if timer=0, operations include continually or periodically determining if timer=0. Further, if timer=0, operations may include determining if the temperature is less than or equal to 40° F. and greater than or equal to 33° F. (e.g., 40° F.≥T≥33° F. 460). Responsive to determining that the temperature is not less than or equal to 40° F. and greater than or equal to 33° F., operations include generating an alert (e.g., send alert 422) to the computing device indicating the temperature is not less than or equal to 40° F. and greater than or equal to 33° F. Responsive to determining that the temperature is less than or equal to 40° F. and greater than or equal to 33° F., operations include generating a warning (e.g., send warning 420) indicating that the temperature is less than or equal to 40° F. and greater than or equal to 33° F.

Figure 5:
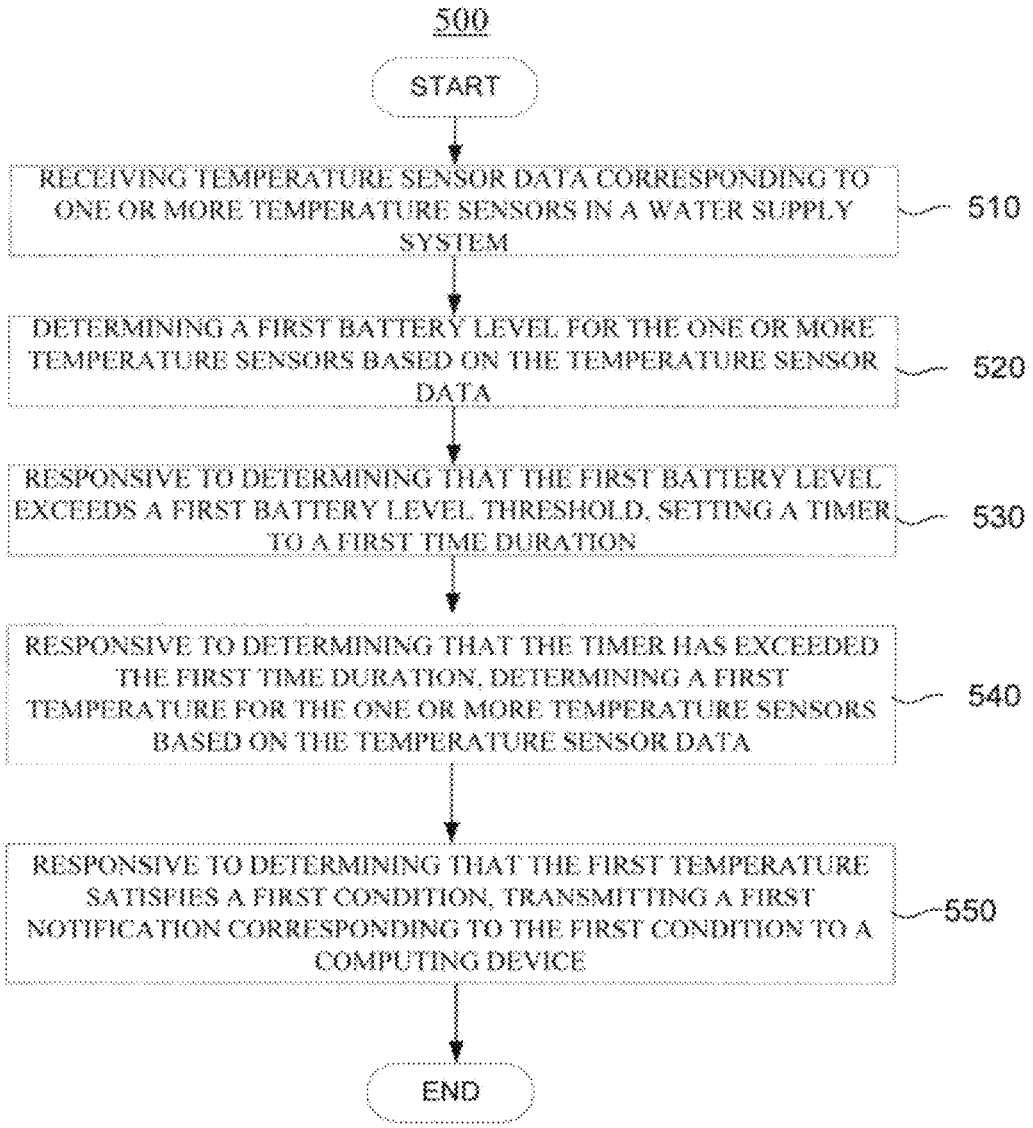
FIG. 5 illustrates a flowchart of power management and control operations, in accordance with an embodiment of the present disclosure.

FIG. 5 illustrates a flowchart of power management and control operations, in accordance with an embodiment of the present disclosure. In an embodiment, computer-implemented method 500 may include one or more processors configured for receiving 510 temperature sensor data corresponding to one or more temperature sensors in a water supply system. Operations include determining 520 a first battery level for the one or more temperature sensors based on the temperature sensor data. Responsive to determining that the first battery level exceeds a first battery level threshold, operations include setting 530 a timer to a first time duration. Responsive to determining that the timer has exceeded the first time duration, operations include determining 540 a first temperature for the one or more temperature sensors based on the temperature sensor data. Responsive to determining that the first temperature satisfies a first condition, operations include transmitting a first notification corresponding to the first condition to a computing device. The temperature sensor data may include temperature data corresponding to ambient temperatures detected at the one or more temperature sensors and battery level data corresponding to battery charge levels of the one or more temperature sensors. Responsive to determining that the first condition corresponds to the one or more temperature sensors detecting a temperature that is greater than or equal to 70 degrees Fahrenheit, operations include setting the timer to a second time duration that is greater than the first time duration.

Responsive to determining that the first condition corresponds to the one or more temperature sensors detecting a temperature that is greater than or equal to 40 degrees Fahrenheit and less than or equal to 33 degrees Fahrenheit, operations include setting the timer to a third time duration that is less than the first time duration, wherein the notification may be a warning about the first condition. The one or more temperature sensors may be removably affixed to a water supply valve using a valve clamp, and the water supply valve may be a backflow preventer valve configured to prevent water backflow. Responsive to determining that a temperature at a location of the water supply system is less than 33 degrees Fahrenheit operations include closing a temperature activated switch to energize the one or more temperature sensors prior to receiving the temperature sensor data at the first time.

While FIGS. 3, 4 and 5 illustrate various operations according to one or more embodiments, it is to be understood that not all of the operations depicted in FIG. 3, 4 or 5 are necessary for other embodiments. Indeed, it is fully contemplated herein that in other embodiments of the present disclosure, the operations depicted in FIGS. 3 and/or 4 and/or 5, and/or other operations described herein, may be combined in a manner not specifically shown in any of the drawings, but still fully consistent with the present disclosure. Thus, claims directed to features and/or operations that are not exactly shown in one drawing are deemed within the scope and content of the present disclosure.

As used in this application and in the claims, a list of items joined by the term "and/or" can mean any combination of the listed items. For example, the phrase "A, B and/or C" can mean A; B; C; A and B; A and C; B and C; or A, B and C. As used in this application and in the claims, a list of items joined by the term "at least one of" can mean any combination of the listed terms. For example, the phrases "at least one of A, B or C" can mean A; B; C; A and B; A and C; B and C; or A, B and C.

"Circuitry", as used in any embodiment herein, may comprise, for example, singly or in any combination, hardwired circuitry, programmable circuitry such as processors comprising one or more individual instruction processing cores, state machine circuitry, and/or firmware that stores instructions executed by programmable circuitry. The circuitry may be configured to execute code or instruction sets, and such code or instruction sets may be embodied as software, firmware, etc. Software may be embodied as a software package, code, instructions, instruction sets and/or data recorded on non-transitory, computer-readable storage devices. Firmware may be embodied as code, instructions or instruction sets and/or data that are hard-coded (e.g., non-volatile) in memory devices. The circuitry may, collectively or individually, be embodied as circuitry that forms part of a larger system, for example, an integrated circuit (IC), system on-chip (SoC), application-specific integrated circuit (ASIC), programmable logic devices (PLD), digital signal processors (DSP), field programmable gate array (FPGA), logic gates, registers, semiconductor device, chips, microchips, chip sets, etc.

Any of the operations described herein may be implemented in a system that includes one or more non-transitory storage devices having stored therein, individually or in combination, instructions that when executed by circuitry perform the operations. Here, the circuitry may include any of the aforementioned circuitry including, for examples, one or more processors, ASICs, ICs, etc., and/or other programmable circuitry. Also, it is intended that operations described herein may be distributed across a plurality of physical devices, such as processing structures at more than one different physical location. The storage device includes any type of tangible medium, for example, any type of disk including hard disks, floppy disks, optical disks, compact disk read-only memories (CD-ROMs), compact disk rewritables (CD-RWs), and magneto-optical disks, semiconductor devices such as read-only memories (ROMs), random access memories (RAMs) such as dynamic and static RAMs, erasable programmable read-only memories (EPROMs), electrically erasable programmable read-only memories (EEPROMs), flash memories, Solid State Disks (SSDs), embedded multimedia cards (eMMCs), secure digital input/output (SDIO) cards, magnetic or optical cards, or any type of media suitable for storing electronic instructions. Other embodiments may be implemented as software executed by a programmable control device.

The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims. Accordingly, the claims are intended to cover all such equivalents. Various features, aspects, and embodiments have been described herein. The features, aspects, and embodiments are susceptible to combination with one another as well as to variation and modification, as will be understood by those having skill in the art. The present disclosure should, therefore, be considered to encompass such combinations, variations, and modifications.

Reference throughout this specification to "one embodiment" or "an embodiment" means that a particular feature, structure, or characteristic described in connection with the embodiment is included in at least one embodiment. Thus, appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

What is claimed:

1. A system to monitor and control a water supply, comprising:

a plumbing fixture coupled to a water supply;

a temperature sensor to generate temperature sensor data indicative of an ambient temperature around the plumbing fixture; and a controller including a battery power supply, the controller is configured to:

determine a first battery level of the battery power supply;

responsive to determining that the first battery level exceeds a first battery level threshold, set a timer to a first time duration;

responsive to expiration of the first time duration, determine a first temperature for the one or more temperature sensors based on the temperature sensor data; and responsive to determining that the first temperature satisfies a first condition, cause a transmission of a first notification corresponding to the first condition to a remote computing device.

2. The system of claim 1, wherein responsive to determining that the first condition corresponds to the one or more temperature sensors detecting a temperature that is greater than or equal to 70 degrees Fahrenheit, the controller is further configured to set the timer to a second time duration that is greater than the first time duration.

3. The system of claim 1, wherein responsive to determining that the first condition corresponds to the one or more temperature sensors detecting a temperature that is greater than or equal to 40 degrees Fahrenheit and less than or equal to 33 degrees Fahrenheit, the controller is further configured to set the timer to a third time duration that is less than the first time duration, wherein the notification is a warning about the first condition.

4. The system of claim 1, wherein the temperature sensor is removably affixed to a water supply valve using a valve clamp.

5. The system of claim 1, wherein the plumbing fixture is a backflow preventer valve configured to prevent water backflow.

6. The system of claim 1, further comprising a temperature activated switch and wherein, responsive to determining that a temperature at a location of the plumbing fixture is less than 33 degrees Fahrenheit, the temperature activated switch is configured to close to energize the temperature sensor.

7. A controller for a water supply system, comprising:

a temperature sensor to generate temperature sensor data indicative of an ambient temperature around a plumbing fixture;

a power supply; and power management circuitry configured to:

determine a first battery level of a battery associated with the power supply;

responsive to determining that the first battery level exceeds a first battery level threshold, set a timer to a first time duration;

responsive to expiration of the first time duration, determine a first temperature for the one or more temperature sensors based on the temperature sensor data; and responsive to determining that the first temperature satisfies a first condition, cause a transmission of a first notification corresponding to the first condition to a remote computing device.

8. The system of claim 7, wherein responsive to determining that the first condition corresponds to the one or more temperature sensors detecting a temperature that is greater than or equal to 70 degrees Fahrenheit, the power management circuitry is further configured to set the timer to a second time duration that is greater than the first time duration.

9. The system of claim 7, wherein responsive to determining that the first condition corresponds to the one or more temperature sensors detecting a temperature that is greater than or equal to 40 degrees Fahrenheit and less than or equal to 33 degrees Fahrenheit, the power management circuitry is further configured to set the timer to a third time duration that is less than the first time duration, wherein the notification is a warning about the first condition.

10. The system of claim 7, wherein the temperature sensos is removably affixed to a water supply valve using a valve clamp.

11. The system of claim 7, wherein the plumbing fixture is a backflow preventer valve configured to prevent water backflow.

12. The system of claim 7, further comprising a temperature activated switch and wherein, responsive to determining that a temperature at a location of the plumbing fixture is less than 33 degrees Fahrenheit, the temperature activated switch is configured to close to energize the temperature sensor.

13. A non-transitory storage device that includes machine-readable instructions that, when executed by one or more processors, cause the one or more processors to perform operations, comprising:

determine a first battery level of a battery associated with the power supply;

set a timer to a first time duration responsive to determining that the first battery level exceeds a first battery level threshold;

responsive to expiration of the first time duration, determine a first temperature; and responsive to determining that the first temperature satisfies a first condition, cause a transmission of a first notification corresponding to the first condition to a remote computing device.

14. The non-transitory storage device of claim 13, wherein the machine-readable instructions that, when executed by one or more processors, cause the one or more processors to perform operations, further comprising:

responsive to determining that the first condition corresponds to the one or more temperature sensors detecting a temperature that is greater than or equal to 70 degrees Fahrenheit, the power management circuitry is further configured to set the timer to a second time duration that is greater than the first time duration.

15. The non-transitory storage device of claim 14, wherein the machine-readable instructions that, when executed by one or more processors, cause the one or more processors to perform operations, further comprising:

responsive to determining that the first condition corresponds to the one or more temperature sensors detecting a temperature that is greater than or equal to 40 degrees Fahrenheit and less than or equal to 33 degrees Fahrenheit, the power management circuitry is further configured to set the timer to a third time duration that is less than the first time duration, wherein the notification is a warning about the first condition.

16. The non-transitory storage device of claim 13, wherein the machine-readable instructions that, when executed by one or more processors, cause the one or more processors to perform operations, further comprising:

responsive to determining that a temperature at a location of the plumbing fixture is less than 33 degrees Fahrenheit, close a temperature activated switch to energize the temperature sensor.

17. The non-transitory storage device of claim 13, wherein the temperature sensos is removably affixed to a water supply valve using a valve clamp.

18. The non-transitory storage device of claim 13, wherein the plumbing fixture is a backflow preventer valve configured to prevent water backflow.

* * * * *